United States Patent [19]

Roberts

[11] 4,432,490

[45] Feb. 21, 1984

[54] REAR LOADING SINGLE SERVING PIE CONTAINER AND BLANK FOR FORMING SAME

[75] Inventor: Harry H. Roberts, Roswell, Ga.

[73] Assignee: Champion International Corporation, Stamford, Conn.

[21] Appl. No.: 411,438

[22] Filed: Aug. 25, 1982

[51] Int. Cl.[3] ..... B65D 5/00

[52] U.S. Cl. ..... 229/22

[58] Field of Search ..... 229/22, 16 D, 8, 16 R

[56] References Cited

U.S. PATENT DOCUMENTS

| | | | |
|---|---|---|---|
| 2,372,747 | 4/1945 | Sullivan | 229/22 |
| 2,419,510 | 4/1947 | Van Rosen | 229/22 |
| 2,583,915 | 1/1952 | Whitley | 229/22 |
| 2,609,920 | 9/1952 | Ringler | 229/16 X |
| 4,313,542 | 2/1982 | Roberts | 229/22 |

FOREIGN PATENT DOCUMENTS

| | | | |
|---|---|---|---|
| 101413 | 10/1925 | Austria | 229/22 |
| 776136 | 12/1936 | France | 229/16 |
| 427845 | 5/1935 | United Kingdom | 229/22 |

*Primary Examiner*—Herbert F. Ross

*Attorney, Agent, or Firm*—Evelyn M. Sommer

[57] ABSTRACT

A carton and a blank for forming same are provided for a single serving of dessert pie. The carton formed from the blank is substantially wedge shaped and includes top and bottom panels disposed in parallel relationship. The top and bottom panels each are of isosceles triangular configuration. The top panel is of larger dimensions than the bottom panel thereby reflecting the actual configuration of the pie packaged in the carton erected from the blank. The subject carton erected from the blank includes a plurality of rear opening flaps providing access to the container from the rear portion thereof.

7 Claims, 4 Drawing Figures

REAR LOADING SINGLE SERVING PIE CONTAINER AND BLANK FOR FORMING SAME

BACKGROUND OF THE INVENTION

Single serving size slices of pie that are sold separately offer many advantages to the consumer. Specifically, consumers need only purchase as many slices of pie as they are likely to use at one time. Consequently, there is not likely to be wastage when slices of pie are purchased individually.

Slices of pie that are packaged and sold separately are especially desirable for small households that would seldom consume more than a few slices of pie in one sitting. Thus, the demand for individually packaged slices of pie has grown recently in response to the increasing number of small households.

Packages for single slices of pie have been available for many years. Typically, these packages for single slices of pie have had identical isosceles triangular top and bottom walls connected by side walls that are perpendicular to the top and bottom walls. Prior art paperboard containers having these features include: U.S. Pat. No. 2,220,110 issued to Layton; U.S. Pat. No. 2,701,090 issued to Buttery; U.S. Pat. No. 3,623,650 issued to Watts; and U.S. Pat. No. 3,876,131 issued to Tolaas. Containers similar to those cited above but constructed from plastic material include U.S. Pat. No. 3,620,403 and U.S. Pat. No. 3,620,411, both of which issued to Rump.

A principal deficiency of the above cited prior art containers for single slices of pie is that they do not conform very closely to the configuration of the product packaged therein. Specifically, pies typically have a frusto-conical configuration with the top surface having a larger area than the bottom surface, and with a slanting crust extending therebetween. Each slice of pie is defined by two radii of the entire pie. Thus, the slice of pie cut in this manner will include a top surface that is larger than its bottom surface, and an inclined section of crust extending between the top and bottom surfaces.

The packages shown in the references listed above, however, all include three side walls that are perpendicular to the bottom of the container. Thus, as the pie shifts in the container during shipping the upstanding wall of the container adjacent to the rear crust will contact only the portion of the crust adjacent to the top surface of the slice of pie. This contact between the top part of the crust and the upstanding side wall creates a torque on the delicate crust that often may damage the pie during shipping.

The containers for single slices of pie shown in U.S. Pat. No. 2,583,915 issued to Whitley and U.S. Pat. No. 2,584,379 issued to Chimieliwski both include rear walls that are inclined, and thereby reduce the torque on the crust of the pie. However, these containers include poorly supported top and side walls that could result in damage to the pie in other ways.

U.S. Pat. No. 4,313,542 which issued to Harry H. Roberts and Raymond D. Cote on Feb. 2, 1982 and which is assigned to the assignee of the subject invention is directed to a single serving pie carton and blank that overcomes many of the problems of the prior art containers cited above. Specifically, the container to which U.S. Pat. No. 4,313,542 is directed includes strongly supported side walls that enable the container to retain its configuration during shipping ard storage. Additionally, the container of U.S. Pat. No. 4,313,542 includes an inclined rear wall that more closely conforms to the configuration of the slice of pie and minimizes the torsional forces on the fragile rear crust of the pie.

Despite the many advantages of U.S. Pat. No. 4,313,542 it has been desired to provide an improved carton for single slices of pie that can provide for easier insertion and removal of the slice of pie. Specifically, U.S. Pat. No. 4,313,542 and the previously cited references are directed to cartons that provide for loading and unloading of the slice of pie from the top. This top loading feature is difficult to accomplish with the automatic packaging devices used by most bakeries, and damage to the slices of pie is possible when the packaging devices are operated at high speed. Additionally, it also is difficult for the consumer to remove the pie from the top of the container without damaging the slice of pie. A container that provides a level of protection for the slice of pie comparable to that of U.S. Pat. No. 4,313,542, and that also enables the slices of pie to be loaded and unloaded from the rear of the container would be desirable. U.S. Pat. No. 3,142,430 issued to Meyers is directed to a self-erecting wedge shaped carton especially adapted to contain sandwiches, cakes and the like. Although the carton of U.S. Pat. No. 3,142,430 provides for side loading, it also is characterized by three side walls that are perpendicular to the top and bottom walls. As explained above, this construction would poorly protect a slice of pie placed in this carton. Additionally, the self-erecting features reduce the strength of the carton shown in U.S. Pat. No. 3,142,430, thereby further increasing the possibility of damage to the fragile slice of pie during shipping or storage.

In view of the above it is an object of the subject invention to provide a container for a single slice of pie that enables easy loading and removal of the pie from the rear of the container.

It is another object of the subject invention to provide a container for a single slice of pie that enables loading of the pie into the container at a desirably fast rate by automatic packaging devices.

It is an additional object of the subject invention to provide a container for a single slice of pie that provides the necessary support for the pie during shipping and storage.

It is a further object of the subject invention to provide a container for a single slice of pie that includes an inclined rear wall that conforms to the configuration of the slice of pie, and may be loaded from the rear of the container.

It is yet another object of the subject invention to provide a container for a single slice of pie that can be manufactured easily and inexpensively from a single blank of paperboard material.

SUMMARY OF THE INVENTION

The subject invention provides a rear opening wedge shaped carton for a single slice of pie. More particularly, the subject carton is constructed from a single blank of paperboard material and includes top and bottom panels that are disposed in spaced parallel relationship to one another. The top and bottom panels each have an isosceles triangular configuration with a pair of equal side edges and a base edge. A pair of substantially identical upstanding side walls are foldably connected to and extend between the top and bottom panel side edges. Top and bottom end flaps are foldably connected respectively to the base edges of the top and bottom panels. An end tab is foldably connected to the rear edge of each side wall. The top and bottom flaps and rear tabs combine to define the rear wall of the subject container. More specifically, the top and bottom rear flaps may be rotated about their hinged connection to the top and bottom panels to effectively open or close the subject container. Thus, the subject container provides access from the rear rather than from the top as in the prior art containers for single slices of pie. This structure enables the baker and the consumer to slide a slice of pie into or out of the subject container along a plane parallel to the bottom surface of the pie. This construction enables the fragile slice of pie to be adequately supported during the entire time it is being placed in or removed from the subject container.

To provide support for the fragile slice of pie during shipping and storage, the subject container is adapted to conform very closely to the shape of the slice of pie. Specifically, a whole pie has a frusto-conical geometric configuration with a top surface that is larger than the bottom surface and with the side edges of the pie extending upwardly and outwardly from the bottom surface to the top surface. It logically follows that a wedge shaped slice defined by two radii of the whole pie also has a top surface larger than its bottom surface. Similarly, the rear edge, or crust, of the pie slice extends angularly upwardly and away from the bottom surface toward the top surface.

The subject container substantially conforms to the configuration of the slice of pie. Thus, although the top and bottom panels of the subject container define similar isosceles triangles, the top panel is larger than the bottom panel. The side walls of the subject container have a configuration that conforms to the radial slices that extend through the frusto-conical shaped pie. More particularly, the side walls of the subject container each define a trapezoid in which the parallel edges are disposed adjacent the parallel top and bottom panels. The front edge of each trapezoidal side wall is perpendicular to the top and bottom panels. However, the rear edge of each trapezoidal side panel is inclined to conform to the inclined rear crust on the slice of pie.

To accommodate the different dimensions of the top and bottom panels, the top and bottom rear flaps each define isosceles trapezoids. Thus, as explained in greater detail below, the rear flaps will completely close the rear of the container but will not extend beyond the planes of the side walls.

The blank for forming the subject container includes two substantially identical trapezoidal side wall panels. Each trapezoidal side wall panel includes two parallel edges and two non-parallel edges. The side wall panels are foldably connected to one another along an edge that is perpendicular to the parallel edges of each side wall panel. Additionally, the side wall panels are disposed such that the longer parallel edges of the two side wall panels are colinear and such that the shorter parallel edges of the two side wall panels also are colinear. The fold line between the two side wall panels will define the front edge of the carton erected from the subject blank.

An isosceles triangular top panel having a pair of equal side edges and a base edge is foldably connected to a side wall panel such that the longer parallel edge of the side wall panel defines a side edge of the top panel. More particularly, the top panel is disposed with respect to the two trapezoidal side wall panels such that the intersection of the equal side edges of the top panel is adjacent the foldable connection between the side wall panels. In a similar manner, an isosceles triangular bottom panel having a pair of equal side edges and a base edge is foldably connected to a side wall panel such that a shorter parallel edge of a side wall panel defines one of the equal side edges of the bottom panel. As with the top panel, the bottom panel is disposed such that the intersection of the equal side edges of the bottom panel is adjacent the hinged connection between the side wall panels.

The blank further includes top and bottom flaps that are hingedly connected respectively to the base edges of the top and bottom panels. The top and bottom flaps are identical isosceles trapezoids. The top flap is hingedly connected to the top panel such that the base edge of the top panel defines the longer parallel edge of the top flap. The bottom flap is hingedly connected to the bottom panel such that the base edge of the bottom panel defines the shorter parallel edge of the bottom flap. Glue flaps are foldably connected to the remaining parallel edges of the side wall panels, and rear tabs are foldably connected to the remaining non-parallel edges of the side wall panels.

As explained further herein, the subject blank can be erected to define a wedge shaped carton having an inclined rear wall that conforms to the shape of the slice of pie packaged therein, and further having a rear opening that enables the slice of pie to be easily inserted into or removed from the carton. Additionally, the subject blank enables the construction of a container that provides the required level of protection with a minimum amount of paperboard material. The blank also is designed to enable the carton to be erected quickly and inexpensively by known devices.

DETAILED DESCRIPTION OF THE PREFERRED EMBODIMENTS

Figure 1:
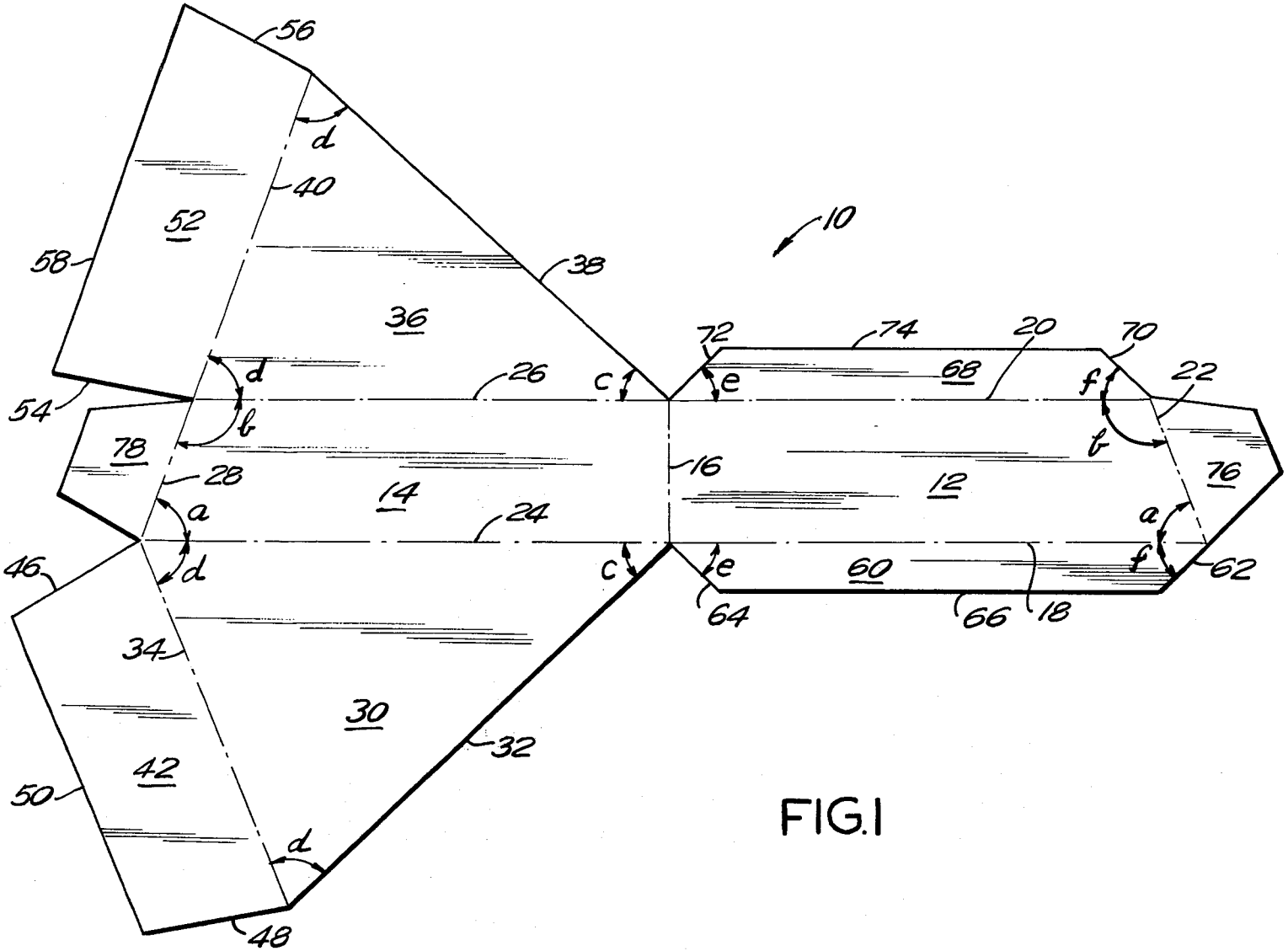
FIG. 1 is a first embodiment of a blank for forming a container of the subject invention.

The rear-opening wedge-shaped container of the subject invention is erected from a paperboard blank 10 as shown in FIG. 1. Blank 10 includes trapezoidal side panels 12 and 14 that are foldably connected to one another along a fold line 16 which will define the front side edge of the carton erected from blank 10. Side wall panel 12 also includes parallel edges 18 and 20 which are both perpendicular to fold line 16. Edge 18 will define one of the top side edges of the carton erected from blank 10. Edge 20 will define a bottom side edge of the carton erected from blank 10, and thus edge 20 is shorter than edge 18. Edge 22 of side wall panel 12 extends between edges 18 and 20 and defines the edge of side wall panel 12 opposite but not parallel to fold line 16. Edge 22 will define one of the rear side edges of the container erected from blank 10.

Side wall panel 14 is of substantially identical size and configuration as side wall panel 12, and as mentioned above, is foldably connected to side wall panel 12 along fold line 16. More particularly, side wall panel 14 is further defined by parallel edges 24 and 26 which extend perpendicularly from fold line 16. Edges 18 and 24 of side wall panels 12 and 14 respectively are substantially colinear with one another and are of equal length. Similarly, edges 20 and 26 of side wall panels 12 and 14 respectively also are substantially colinear with one another and are of substantially equal length. Edge 24 will define a top side edge of the carton erected from blank 10, and is longer than edge 26 which will define a bottom side edge of the carton. Edge 28 of side wall panel 14 extends between edges 24 and 26 thereof, and defines the edge of side wall panel 14 that is opposite but not parallel to fold line 16.

The angles "a" and "b" formed by the intersections of edge 28 with parallel edges 24 and 26 of side wall panel 14 equal the angles "a" and "b" formed by the intersections of edge 22 with the parallel edges 18 and 20 of side wall panel 12. The magnitude of angles "a" and "b" will depend upon the configuration of the slice of pie packaged in the container erected from blank 10. Specifically, angles "a" and "b" will vary according to the relative difference in size of the top and bottom surfaces of the slice of pie. However, angle "a" will always be less than 90° and angle "b" will always be greater than 90°.

Top panel 30 is foldably connected to side wall panel 14 along edge 24 thereof. More particularly, top panel 30 defines an isosceles triangle defined by equal side edges 24 and 32 and base edge 34. The side edges 24 and 32 of the isosceles triangular top panel 30 will form the top side edges of the carton erected from blank 10 and intersect one another adjacent fold line 16. The base edge 34 of the isosceles triangular top panel 30 will define the top rear edge of the carton erected from the blank. Angle "c" defines the angular separation between edges 24 and 32 of top panel 30. The magnitude of angle "c" will vary according to the relative proportion of the whole pie that is packaged in the container erected from blank 10. For example, if the pie is cut into eighths, angle "c" will equal 45°. Similarly, if the pie is cut into sixths, angle "c" will equal 60°, and top panel 30 in that case will define an equilateral isosceles triangle.

Bottom panel 36 is connected to side wall panel 14 along edge 26 thereof. More particularly, bottom panel 36 defines an isosceles triangle which is formed by base edge 40 and by equal side edges 26 and 38 which intersect one another adjacent fold line 16. Side edges 26 and 38 of bottom panel 36 are shorter than side edges 24 and 32 of top panel 30 However, the angle "c" separating edges 26 and 38 of bottom panel 36 is substantially equal to the angle "c" separating edges 24 and 32 of top panel 30. Thus, top and bottom panels 30 and 36 define similar isosceles triangles and the remaining angles "d" formed therein also will be equal.

Top rear flap 42 is of isosceles trapezoidal configuration, and is foldably connected to top panel 30 such that edge 34 of top panel 30 defines the longer parallel edge of top rear flap 42. Edges 46 and 48 of top rear flap 42 extend from edge 34 at an angle of less than 90°, such that edges 46 and 48 are angled toward one another. Edge 50 of top rear flap 42 extends between edges 46 and 48 and defines the shorter parallel edge of top rear flap 42. Additionally, edge 50 of top rear flap 42 is substantially equal in length to base edge 42 of bottom panel 36. On the carton erected from blank 10, top rear flap 42 will be folded about edge 34 so that edge 50 is immediately adjacent to base edge 40 of bottom panel 36.

Bottom rear flap 52 also is an isosceles trapezoid, and is of substantially the same size and configuration as top rear flap 42. More particularly, bottom rear flap 52 is foldably connected to bottom panel 36 such that edge 40 of bottom panel 36 defines the shorter parallel edge of bottom rear flap 52. Edges 54 and 56 of bottom rear flap 52 extend from edge 40 at an angle greater than 90° so that edges 54 and 56 extend away from one another. Edge 58 of bottom rear flap 52 extends between edges 54 and 56 and defines the longer parallel edge of bottom rear flap 52. Because the top and bottom rear flaps 42 and 52 are substantially identical, edge 58 of bottom rear flap 52 will be substantially equal in length to edge 34 of top rear flap 42. On the carton erected from blank 10, bottom rear flap 52 will be rotated so that edge 58 is adjacent edge 34 of top rear flap 42. Thus, on the erected carton top and bottom rear flaps 42 and 52 will be in face to face contacting relationship to define the rear of the carton.

Top glue flap 60 is foldably connected to side wall panel 12 along edge 18 thereof. Top glue flap 60 is defined by edges 62 and 64 that are angularly directed toward one another, and by edge 66 which extends between edges 62 and 64. The angle "e" defined by edges 18 and 64 of top glue flap 60 is less than or equal to the angle "c" on top panel 30 to enable the proper erection of the subject container as explained further below. Similarly, the angle "f" defined by edges 18 and 62 of top glue flap 60 is less than or equal to the angle "d" also to enable the proper erection of the subject container from blank 10.

Bottom glue flap 68 is foldably connected to edge 20 of side wall panel 12. Bottom glue flap 68 includes edges 70 and 72 that are angularly directed toward one another and edge 74 extending between edges 70 and 72 at the ends thereof opposite side wall panel 12. As explained above, the angle "e" defined by the intersection of edges 20 and 72 of bottom glue flap 68 is less than or equal to the angle "c" on bottom panel 36. Similarly, the angle "f" defined by the intersection of edges 20 and 70 of bottom glue flap 68 is less than or equal to the angle "d" on bottom panel 36. As explained further below, top and bottom glue flaps 60 and 68 are adhesively connected to the top and bottom panels 30 and 36 respectively to erect the subject container from blank 10.

Rear tab 76 is foldably connected to side wall panel 12 along edge 22 thereof. Similarly, rear tab 78 is foldably connected to side wall panel 14 along edge 28 thereof. Rear tabs 76 and 78 are substantially trapezoidal members with edges 22 and 28 respectively defining the longer parallel edge of each trapezoid. This configuration ensures that rear tabs 76 and 78 will not interfere with the closing of the container erected from blank 10.

Figure 2:
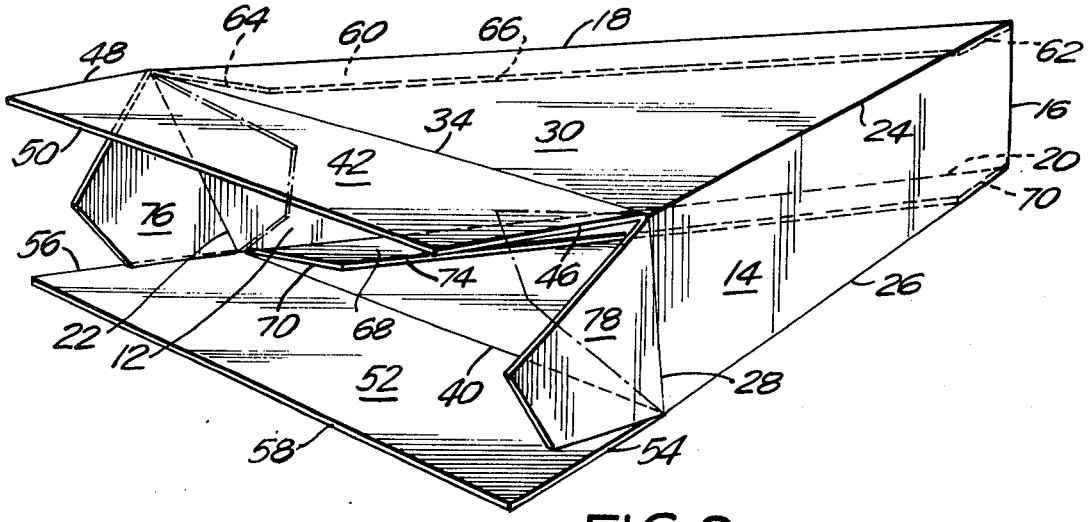
FIG. 2 is a perspective view of a partially erected container formed from the blank of FIG. 1.
Figure 3:
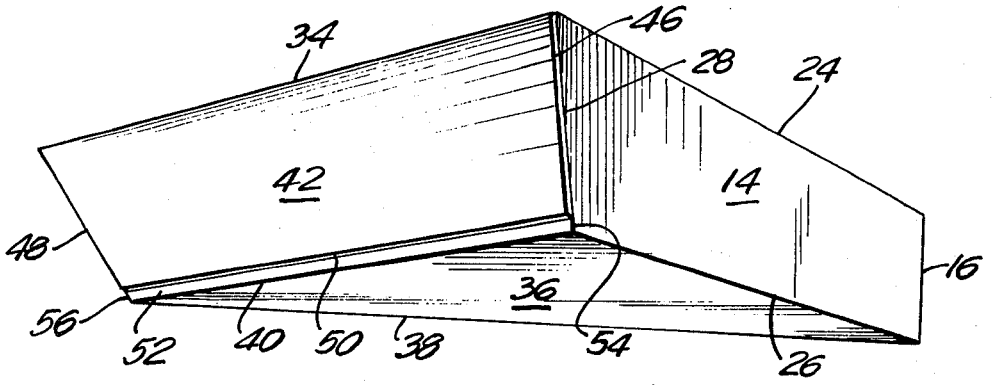
FIG. 3 is a perspective view of the fully erected container formed from the blank of FIG. 1.

To erect the container 80,as shown in FIGS. 2 and 3, from the blank 10 that was described above and illustrated in FIG. 1, side wall panels 12 and 14 are rotated toward one another about fold line 16 to enable a separation between side wall panels 12 and 14 approximately equal to angle "a". Top and bottom panels 30 and 36 then are rotated about edges 24 and 26 respectively until they are substantially parallel to one another and perpendicular to side wall panel 14. Side wall panels 12 and 14 are secured in this angular relationship by adhesively connecting top glue flap 60 to top panel 30 along the portion thereof adjacent edge 32. Similarly, bottom glue flap 68 is adhesively secured to bottom panel 36 along the portion thereof adjacent edge 38. The adhesive connection of top and bottom glue flaps 60 and 68 to top and bottom panels 30 and 36 results in the erected carton 80 as shown in FIG. 2. Typically, the formation of this much of the carton 80 as shown in FIG. 2 would be accomplished with an automatic device employing a mandrel about which carton 80 would be formed.

On the partially erected carton 80 shown in FIG. 2, top and bottom panels 30 and 36 are substantially parallel to one another and side wall panels 12 and 14 extend orthagonally between top and bottom panels 30 and 36. Additionally, the fold line 16 described above and shown in FIG. 1 defines the front side edge of carton 80 and is substantially perpendicular to the top and bottom panels 30 and 36. As explained previously, the edges 24 and 32 of top panel 30 are longer than the edges 26 and 38 of the bottom panel 36. As a result, edges 22 and 28 extend angularly upward and away from bottom panel 36 towards top panel 30. The precise angular configuration is selected to ensure that the rear crust of the slice of pie inserted in container 80 will be properly supported during shipping and storage after the flaps of container 80 are closed as explained further below.

As illustrated in FIG. 2, top and bottom rear flaps 42 and 52 and rear tabs 76 and 78 are in an open disposition, enabling the slidable insertion of the slice of pie into the rear of container 80. The insertion of the slice of pie into the rear of container 80 in this manner, can be accomplished quickly and easily by mechanized packing equipment without a substantial likelihood of damaging the pie. The pie also may be removed easily from the subject container 80 with considerable ease and with little likelihood of damaging the pie.

The container 80 is closed as shown in FIG. 3 by rotating rear tabs 76 and 78 about edges 22 and 28 until rear tabs 76 and 78 are substantially in line with edges 34 and 40 of top and bottom panels 30 and 36 respectively. Bottom and top rear flaps 52 and 42 then are alternately rotated about edges 40 and 34 to define a plane extending substantially between the top and bottom base edges 34 and 40. Top and bottom rear flaps 42 and 52 may be secured in this abutting relationship by any known means such as adhesive. An appropriate opening member may be provided on the top rear flap 42 to facilitate the opening of container 80.

The container 80 erected in the manner described above, and as shown most clearly in FIG. 3, is of virtually the same size and shape as the pie slice inserted therein. More particularly, the top and bottom rear flaps 42 and 52 as shown in FIG. 3 are disposed at an angle with respect to the top and bottom panels 30 and 36. As explained above, this angular relationship of the top and bottom rear flaps 42 and 52 with respect to top and bottom panels 30 and 36 reflects the angular disposition of the crust of the pie stored in container 80 with respect to the top and bottom surfaces of the pie. As a result, during shipping the top and bottom rear flaps 42 and 52 will contact a portion of the crust extending between the top and bottom surfaces of the pie. Consequently, the torsional forces exerted on the delicate crust of the pie will be minimized and the pie is less likely to become damaged.

Figure 4:
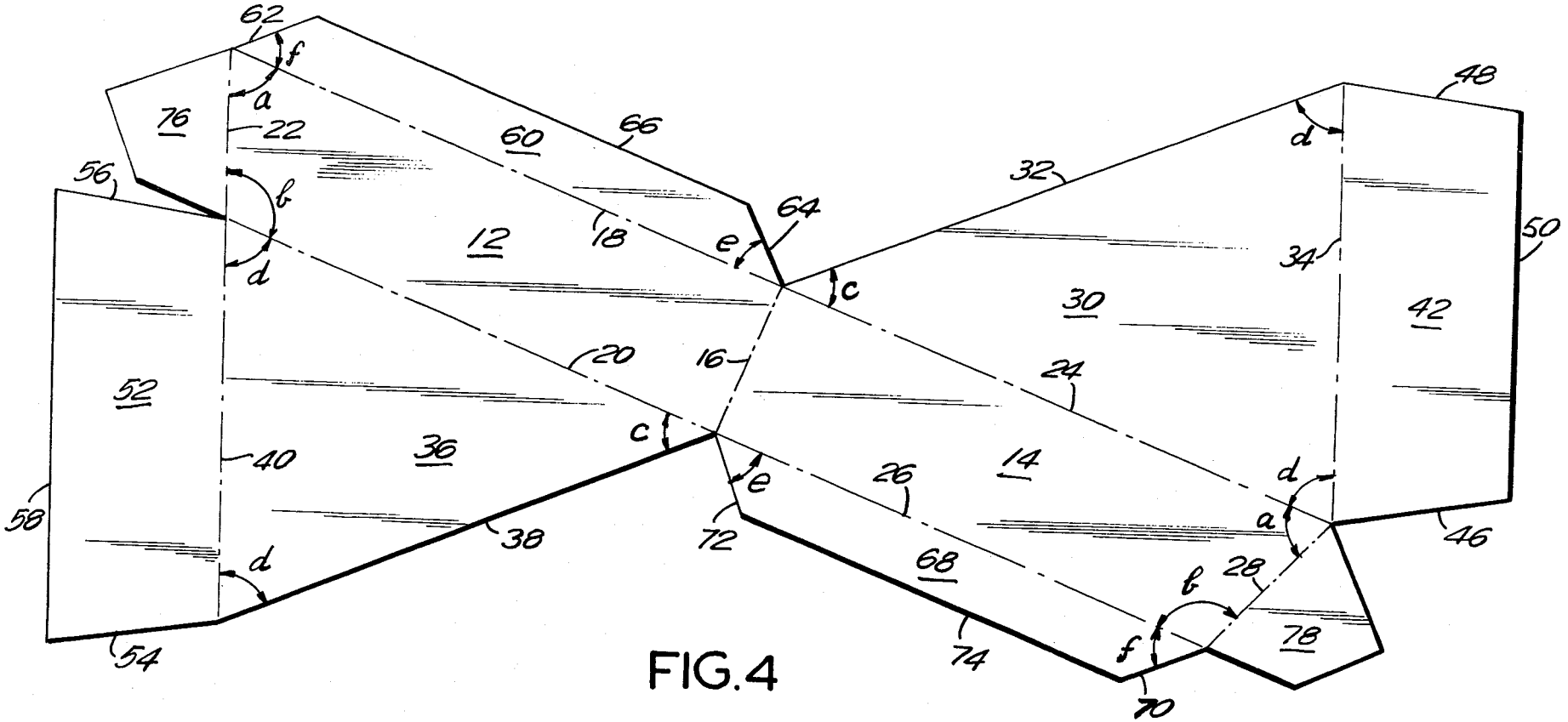
FIG. 4 is a second embodiment of the blank of the subject invention.

FIG. 4 shows an alternate blank for forming the container shown in FIGS. 2 and 3 above. This alternate blank, as shown in FIG. 4, is configured to enable a savings of paperboard material during the die cutting of the blanks. The structural members of the blank shown in FIG. 4 have been numbered identically to the comparable numbers shown in FIG. 1 through 3 above. The blank 10 shown in FIG. 4 includes trapezoidal side wall panels 12 and 14 that are foldably connected to one another along a fold line 16. As with the blank shown in FIG. 1, the fold line 16 on the alternate blank shown in FIG. 4 will define the front side edge of the carton erected from blank 10. Side wall panel 12 also includes parallel edges 18 and 20 which extend perpendicularly from the fold line 16. Edges 18 and 20 will define top and bottom side edges respectively of the container erected from the blank 10 shown in FIG. 4. As a result, edge 18 is longer than edge 20 reflecting the fact that the top surface of the subject container will be larger than the bottom surface thereof. The rear edge 22 of side wall panel 12 extends angularly between edges 18 and 20 and defines the edge of side wall panel 12 opposite the fold line 16.

As with the blank illustrated in FIG. 1, the side wall panel 14 of the alternate blank shown in FIG. 4 is substantially identical to side wall panel 12. Side wall panel 14 includes parallel edges 24 and 26 which extend orthagonally from fold line 16 and are colinear with edges 18 and 20 respectively. Edge 28 extends angularly between edges 24 and 26 of side wall panel 14 thereby defining the edge of side wall panel 14 opposite fold line 16.

The top panel 30 is foldably connected to the side wall panel 14 along edge 24 thereof. As with the blank explained above with reference to FIG. 1, the top panel 30 defines an isosceles triangle having equal side edges 24 and 32 and base edge 34.

The blank shown in FIG. 4 differs significantly from that shown in FIG. 1, in that in the alternate embodiment the bottom panel 36 is foldably connected to the side wall panel 12 rather than to side wall panel 14. Thus, on the alternate blank, the top and bottom panels 30 and 36 are foldably connected to different side panels rather than to the same side wall panel. This configuration results in a more symmetrical blank with a resulting saving in paperboard material. The blank shown in FIG. 4 is similar to that shown in FIG. 1 in that the bottom panel 36 is foldably connected to one of the shorter parallel edges of the side wall panels 12 and 14, and in that the equal side edges 20 and 38 of bottom panel 36 intersect one another adjacent fold line 16.

Top rear flap 42 defines an isosceles trapezoid foldably connected to the base edge 34 of isosceles triangular top panel 30 such that edge 34 defines the longer parallel edge of top rear panel 42. Edges 46 and 48 of top rear flap 42 extend from edge 34 toward one another and terminate at edge 50 which defines the shorter parallel edge of top rear flap 42. Edge 50 of top rear flap 42 and the base edge 40 of bottom panel 36 are of substantially equal length.

The bottom rear flap 52 also is an isosceles trapezoid having substantially the same size and configuration as the top rear flap 42. However, the foldable connection 40 between the bottom rear flap 52 and the bottom panel 36 defines the shorter parallel edge of bottom rear flap 52. Thus, the edges 54 and 56 extend away from one another as they proceed from edge 40. Edge 58 of bottom rear flap 52 is the longer parallel edge of bottom rear flap 52 and substantially equals edge 34 of top panel 30.

Glue flap 60 is foldably connected to side wall panel 12 along edge 18. Glue flap 68 is foldably connected to side wall panel 14 along edge 26. Thus, in the embodiment shown in FIG. 4, glue flaps 60 and 68 are foldably connected to different side wall panels, rather than to the same side wall panel of the blank illustrated in FIG. 1. Rear tabs 76 and 78 are foldably connected to side wall panels 12 and 14 along edges 22 and 28 respectively.

To erect the container formed from the embodiment of the blank 10 illustrated in FIG. 4, the side wall panels 12 and 14 are first rotated toward one another about fold line 16 until the angular separation between side wall panels 12 and 14 approximately equals angle "c". The top and bottom panels 30 and 36 then are rotated toward one another about the fold lines 24 and 20 respectively until they are substantially parallel to one another and perpendicular to side wall panels 12 and 14. Glue flap 60 then is secured to top panel 36 adjacent edge 32 thereof. Similarly, glue flap is adhesively secured to bottom panel 36 adjacent edge 38 thereof. The resultant structure will substantially correspond to the structure shown in FIG. 2, with the only difference being that glue flap 68 would be adjacent to side wall panel 14 rather than being adjacent to side wall panel 12, in the embodiment shown in FIG. 2.

In summary, there is provided a paperboard container for single servings of pie, and a blank for forming the same. The subject container is substantially wedge shaped and is dimensioned to approximatley the same size as the slice of pie therein. The top and bottom panels of the subject container define similar isosceles triangles. However, the top panel is larger than the bottom panel reflecting the fact that the top surface of a slice of pie is larger than the bottom surface. The side wall panels of the subject container are substantially trapezoidal in configuration so that the rear edges extend upwardly and away from the bottom panel of the container toward the top panel of the container. Thus, the subject container provides the necessary support for the fragile piece of pie stored therein. The opening members of the subject container are defined by isosceles trapezoidal flaps foldably connected to the base edges of the isosceles triangular top and bottom panels. These opening flaps would be disposed adjacent to the delicate rear crust portion of the slice of pie inserted in the container. This rear opening configuration makes the subject container particularly well adapted for automated packaging devices, and substantially minimizes the risk of damage to the pie during packaging. The rear opening configuration also facilitates the removal of the piece of pie from the subject container by the consumer, thereby further minimizing the damage to the pie prior to its consumption.

While preferred embodiments of the subject invention has been described and illustrated, it is obvious that various changes and modifications can be made therein without departing from the spirit of the present invention which should be limited only by the scope of the appended claims.

What is claimed is:

1. A paperboard blank for forming a wedge-shaped pie carton having an openable slanted rear wall, said blank comprising:

first and second substantially identical trapezoidal side wall panels, each said side wall panel including parallel top and bottom edges and non-parallel first and second side edges, the top edges of said side wall panels being longer than the bottom edges thereof, the first side edges of said side wall panels being a common edge perpendicular to the top and bottom edges thereof, said side wall panels being foldably connected along said common edge such that the top and bottom edges of the first side wall panel are colinear respectively with the top and bottom edges of the second side wall panel;

an isosceles triangular top panel having first and second equal side edges and a base edge, said first side edge of said top panel and the top edge of one said side wall panel being a common edge hingedly connected and of equal length, said first and second side edges of said top panel intersecting one another adjacent the foldable connection of said first and second side wall panels;

an isosceles triangular bottom panel having first and second equal side edges and a base edge, said first side edge of said top panel and the bottom edge of one said side wall panel being a common edge hingedly connected and of equal length, said first and second side edges of said top panel intersecting one another adjacent the foldable connection of said first and second side wall panels, the angular separation of said first and second side edges of said bottom panel being equal to the angular separation between the first and second side edges of the top panel;

an isosceles trapezoidal top panel flap having parallel top and bottom edges and non-parallel side edges, said top edge of said top panel flap and said base edge of said top panel being a common edge hingedly connected and of equal length, said bottom edge of said top panel flap and said base edge of said bottom panel being of equal length, said side edges of said top panel flap and the second side edges of said side wall panels being of equal length; and an isosceles trapezoidal bottom panel flap substantially identical to said top panel flap, said bottom panel flap having parallel top and bottom edges and non-parallel side edges, said bottom edge of said bottom panel flap and said base edge of said bottom panel being a common edge hingedly connected and of equal length.

2. A blank as in claim 1 wherein a top glue flap is foldably connected to the top edge of the side wall panel adjacent the side wall panel hingedly connected to the top panel, and wherein a bottom glue flap is hingedly connected to the bottom edge of the side wall panel adjacent the side wall panel hingedly connected to the bottom panel.

3. A blank as in claim 1 wherein a rear tab is foldably connected respectively to each said side wall panel along the respective second side edges thereof.

4. A blank as in claim 1 wherein said top and bottom panels are hingedly connected to said first side wall panel.

5. A blank as in claim 4 wherein top and bottom glue flaps are hingedly connected to said second side wall panel along the top and bottom edges thereof respectively.

6. A blank as in claim 1 wherein said top panel is hingedly connected to said first side wall panel and wherein said bottom panel is hingedly connected to said second side wall panel.

7. A blank as in claim 6 wherein a top glue flap is hingedly connected to the top edge of said second side wall panel, and a bottom glue flap is hingedly connected to the bottom edge of said first side wall panel.

* * * * *